US005429303A

United States Patent [19]

Winheim

[11] Patent Number: 5,429,303

[45] Date of Patent: Jul. 4, 1995

[54] STEAM SPRAY TUBE WITH LINEAR ACCELERATION CHANNEL

[75] Inventor: Stefan H. Winheim, Frankfurt, Germany

[73] Assignee: V.I.B. Apparatebau GmbH, Maintal, Germany

[21] Appl. No.: 114,201

[22] Filed: Aug. 30, 1993

[30] Foreign Application Priority Data

Mar. 20, 1993 [DE] Germany ..... 43 09 076.1

[51] Int. Cl.[6] ..... D21G 7/00; B05B 9/03

[52] U.S. Cl. ..... 239/110; 239/136; 239/553; 239/557; 239/562; 239/568

[58] Field of Search ..... 239/110, 132.1, 136, 239/562, 552, 553, 557, 568

[56] References Cited

U.S. PATENT DOCUMENTS

| | | | |
|---|---|---|---|
| Re. 31,065 | 10/1982 | Shelor | 239/562 X |
| 2,642,314 | 6/1953 | Dupasquier | 239/553 X |
| 2,698,201 | 12/1954 | Gillis | 239/568 X |
| 2,718,712 | 9/1955 | Bruker et al. | 239/562 X |
| 2,998,924 | 9/1961 | Schaeffer | 239/136 |
| 3,089,252 | 5/1963 | Daane et al. | 239/557 X |
| 3,467,313 | 9/1969 | Pepmeier | 239/568 X |
| 3,516,607 | 6/1970 | Shelor | 239/557 X |
| 3,574,338 | 4/1971 | Shelor | 239/562 X |
| 3,662,954 | 5/1972 | Pepmeier | 239/568 X |
| 4,050,630 | 9/1977 | Dupasquier | 239/568 X |
| 4,384,873 | 5/1983 | Herr | 239/553 X |
| 4,398,355 | 8/1983 | Dove | 239/568 X |
| 5,020,469 | 6/1991 | Boissevain et al. | 239/562 X |
| 5,122,232 | 6/1992 | Lyman et al. . | |

FOREIGN PATENT DOCUMENTS

4125062A1 2/1993 Germany .

*Primary Examiner*—William Grant
*Attorney, Agent, or Firm*—Peter K. Hahn

[57] ABSTRACT

A steam spray tube with an inlet line (16) for steam, a nozzle arrangement (33) and a valve (19) positioned between the inlet line and the nozzle arrangement is described. With such a steam spray tube, adequate moistening of a web to be moistened can be assured even at high web velocities. To do so, an essentially straight acceleration channel (35) is arranged downstream from valve (19) in the direction of flow of the steam and a nozzle channel (36) to the nozzle arrangement (33) branches off from the acceleration channel at a predetermined distance from the end (37) of the acceleration channel (35).

35 Claims, 5 Drawing Sheets

1
2
3
4
5
6
7
10B'
10B
10A'
10
13
14
12
11
13'
14'
10'
12'
11'
10A
15'
15

III
III
10
11
16
17
18
19
20
21
22
23
24
25
26
27
28
29
30
31
32
33
34
35
36
37
38
39
40
41
42
48
49
50

110
131
133
134
45
44
46
48
36
47
37
38
39
40
49
42
11
35
21
20
19
23
29
25
22
24
27
26
28
30
16
117
50

STEAM SPRAY TUBE WITH LINEAR ACCELERATION CHANNEL

FIELD OF THE INVENTION

This invention concerns a steam spray tube with an inlet line for steam, a nozzle arrangement and a valve arranged between the inlet line and the nozzle arrangement, and this invention also concerns a process for adjusting the gloss and/or smoothness of a web of material passed through a roller gap arrangement with the help of such steam spray tubes, whereby an actual value for the gloss and/or smoothness of the web of material is determined downstream from the roller gap arrangement in the direction of travel of the web of material and then is compared with a setpoint, and the amount of steam dispensed by the steam spray tubes is modified in individual zones as a function of the difference between the actual value and the setpoint.

BACKGROUND OF THE INVENTION

U.S. Pat. No. 5,122,232 discloses a steam spray tube and a process for controlling the amount of steam dispensed by the steam spray tube. The steam spray tube here is arranged beneath a web of material passing through a calender where at least one roller has a highly polished surface. The steam spray tube dispenses steam through its nozzle arrangement and the steam then condenses in the air and is precipitated in the form of a cloud or mist on the web of paper passing by. The resulting increase in moisture content of the paper web has the effect that the paper web can be smoothed better in the downstream roller gap and/or has a higher gloss. The gloss and/or smoothness of the paper web are measured at the end of the calender and the measured values are sent to a control device that controls the valves of the steam spray tube. The valves are designed as digital valves so only a limited precision is possible with regard to the amount of steam dispensed. In order to improve the precision, the pressure to all the steam tubes is readjusted according to given mathematical methods.

One problem with such a moistening process is that a rather thick film of air adheres to the web of material, moving along with it and preventing or at least greatly interfering with the penetration of the steam or the cloud formed by the steam on the web of material. This effect is greater as the speed of travel of the web of material increases. At the same time a web of material traveling at a high speed requires considerably more steam applied per unit of time in order to maintain the same moisture load as a web of material traveling at a slower speed. Furthermore increasing the steam pressure in order to increase the outlet velocity of the steam is not without hazards. At a high steam pressure and a resulting higher steam outlet velocity from the nozzle arrangement, the steam may entrain droplets of water that have formed somewhere in the inlet line or in the steam spray tube itself and may throw them at a high velocity against the web of material where these droplets of water act like projectiles that can perforate the web of material and thus greatly reduce its quality.

Therefore, one object of the present invention is to ensure adequate moistening of the web of material at high processing velocities.

SUMMARY OF THE INVENTION

The present invention ensures adequate moistening of the web of material with a steam spray tube of the type defined initially due to the fact that an essentially linear acceleration channel is arranged downstream from the valve in the direction of flow of the steam and a nozzle channel to the nozzle arrangement branches off from this acceleration channel at a predetermined distance upstream from the end of the acceleration channel.

With such a steam spray tube, the steam pressure and thus the steam velocity can be increased substantially without any fear that water droplets can escape from the nozzle arrangement and damage the web of material. Water droplets which form practically unavoidably somewhere in the line or in the steam spray tube are entrained with the steam but when an acceleration channel is provided, the water droplets are accelerated downstream from the valve in such a way that they cannot also undergo the change in direction to which the steam is subjected in order to enter the nozzle channel that branches off. Instead, they enter the end of the acceleration channel where they can no longer cause any problem but instead can be removed. The distance between the branch in the nozzle channel and the end of the acceleration channel may correspond to a quarter or more of the length of the acceleration channel. The length of the acceleration channel to the branch must be only large enough so that the water droplets along this length can be accelerated to a velocity so great that they can no longer follow the change in direction of the steam due to their inertia. Thus a much higher steam velocity can be achieved with such a steam spray tube, so the steam leaving the nozzle arrangement also reaches the web of material at a higher pressure or a higher velocity. The velocity is so high that the steam or the mist formed by it succeeds in penetrating the layer of air adhering to the web of material and thus it penetrates as far as the web of material, which is then provided with the required amount of moisture so that it can receive the desired gloss or smoothness in the downstream roller gap.

Preferably the acceleration channel is arranged in a channel housing that is located entirely in the interior of the inlet line. The channel housing of the acceleration channel is always kept at a temperature that corresponds to the temperature of the incoming steam. Droplets of water entrained into the acceleration channel, where they remain due to the lack of any opportunity to escape, can then evaporate again and are thus eliminated with no problem.

The acceleration channel is preferably closed off at one end by a baffle plate which has an opening in the area of the lowest point as seen in the direction of gravity. The water droplets accelerated by the steam flow in the acceleration channel strike the baffle plate because they cannot follow the change in direction executed by the steam in the nozzle channel and then they drop down where they can flow out through this opening.

It is especially preferable here for the acceleration channel to be connected through the opening to a discharge channel. The various water droplets thus no longer enter the inlet line but instead are removed or "eliminated" so they no longer cause any problem.

Preferably the opening is designed as a throttle. This assures that the steam pressure in the acceleration channel can be much greater than in the discharge channel. This assures that the steam entering the acceleration channel will in fact leave through the nozzle arrangement and not through the opening. This yields a good efficiency. Furthermore, the size of the opening can be selected so it is mostly closed off by the water flowing out of it.

The valve together with its valve seat and closing piece are preferably arranged in the interior of the inlet line and the drive part is outside the line. The valve seat and closing piece are parts of the valve which are exposed to steam and on which steam can condense. If these two parts are arranged in the interior of the inlet line, they will be preheated by the steam flowing in the inlet line so there will be no condensation of the steam on these parts. On the other hand, however, the drive for the valve is arranged outside the inlet line. Thus it can be kept cool or cold, which can be of crucial importance in the lifetime and satisfactory operation of the drive.

Preferably the drive part is at least thermally separated from the inlet line with its housing. There should be little or no transfer of heat from the inlet line to the drive part, so there cannot be any excessive heating of the drive part on the one hand or dissipation of heat and thus energy loss on the other hand.

Preferably the valve is designed as a pneumatically controlled analog valve and especially as a linear valve. This permits a high precision adjustment of the valve. A gradation such as that used with a digital valve is not necessary. The design as a linear valve facilitates control. A linear valve has a linear correlation between the amount of steam allowed through and the control signal, for example, the pneumatic pressure, under ambient conditions that are otherwise the same. An increase in the control signal by 10% causes a 10% increase in the amount of steam allowed to pass through. This can be accomplished by structural measures, for example, where the valve seat and closing piece are coordinated accordingly.

Preferably the nozzle arrangement is pointed downward in the direction of gravity. Such an alignment has in the past had the disadvantage that water droplets that are entrained in the steam and are not discharged immediately through the nozzles collect in the area of the nozzle arrangement and then necessarily flow into the nozzles sooner or later, where they are ultimately entrained anyway by the steam discharged from the nozzles. Since the steam entering the nozzle arrangement with the steam spray tube according to this invention is practically free of water droplets, the nozzle arrangement can also be operated "overhead" and the top side of the web of material can be treated with steam if this is necessary or desirable.

It is especially preferable for the nozzle arrangement to be arranged opposite a nozzle arrangement of a second steam spray tube whereby the direction of the steam leaving the nozzle arrangement is essentially opposite the direction of the steam leaving the other nozzle arrangement. Then practically both sides of the web of material can be treated at the same time. Both sides of the web of material can also be treated with the desired moisture content essentially independently of each other. In particular they can also be treated with the same amount of moisture, so that a treatment of both sides of the web of material can be performed in the roller gap.

This is especially advantageous when the steam spray tube is arranged upstream from the first roller gap of a roller gap arrangement having several roller gaps, especially in a super calender. Most of the surface treatment takes place in the first roller gap(s) of such a roller gap arrangement. If the side or sides of the web of material are treated with moisture here, the gloss or smoothness result can be improved significantly.

An especially preferred embodiment provides for the nozzle arrangement to have a steam chamber into which the nozzle channel opens on the one side and which is provided with nozzles. Such a steam chamber makes it possible for the steam to be distributed uniformly before it leaves the nozzles. Essentially the same pressure prevails in the same steam chamber, so even if the nozzles are distributed in the space they all receive a uniform flow.

It is preferable here for the steam leaving the nozzle channel to undergo at least one change in direction in the steam chamber. This results in another possibility for separating droplets of water from the steam. The water droplets can not usually undergo the change in direction especially when the steam is flowing at a high velocity, and therefore they are discharged from the stream of steam flowing to the nozzles. As a rule, the water droplets then reach one of the walls of the steam chamber.

It is preferable here to have a baffle plate arranged in the steam chamber in the extension of the nozzle channel. The water droplets that are accelerated again in the nozzle channel, if any water droplets are present at all, are then thrown against this baffle plate. The steam, however, flows out around the baffle plate.

Preferably the normal line of the baffle plate is arranged at an incline with respect to the axis of the nozzle channel. Thus when the steam flows out of the nozzle channel, it strikes an inclined plane and thus can be directed specifically to one wall of the steam chamber. When working with an overhead arrangement of the steam spray tube, water droplets which are formed contrary to expectation can run off the baffle plate and be deflected into an area beneath the nozzles, which are then at the bottom, and then the water droplets can be drained off without causing any problem.

It is also preferable for the baffle plate to be connected to the wall surrounding the mouth of the nozzle channel by means of side walls in which case the side walls open in the direction of one wall of the steam chamber. In this way the steam leaving the nozzle channel is directed to an even greater extent at the corresponding steam chamber wall. The steam travels a longer distance before it reaches an area of the steam chamber where it can be decompressed. This also contributes to a reduction in the formation of droplets.

In addition or as an alternative, the nozzle channel may open eccentrically into the steam chamber, and the nozzles are then arranged outside the projection of the mouth of the nozzle channel onto the outside wall of the steam chamber. The steam flowing through the nozzle channel thus accelerates any droplets of water that might still be present in the direction of one wall of the chamber where they can be precipitated. However, the water droplets cannot leave directly through the nozzles.

It is preferable here for the steam chamber to have an essentially circular cross section and for the nozzle channel to open essentially tangentially into it. Thus the steam is first sent along the wall of the steam chamber before it can leave through the nozzles. This yields a turbulence effect in the steam whereby any droplets of water still present in the steam can be precipitated along the wall of the nozzle chamber.

It is also advantageous for the steam chamber to be arranged in a heated housing. Even when droplets are precipitated on the wall of the steam chamber, they evaporate again very rapidly, so there cannot be any problematical accumulation of water or liquid. However, this design also has the advantage that startup of such a steam tube is facilitated. In other words, when steam is first allowed to enter a cold steam tube, the steam first condenses on the walls where it forms droplets of water that can later escape through the nozzles together with the steam. However, if the steam chamber is located in a housing that is already heated, it will be at the required temperature to prevent condensation of the steam. Even after a period of shutdown, operation of the steam tube can be resumed almost immediately. Due to the fact that the housing of the steam chamber is heated, however, a temperature above the evaporation temperature of the water also prevails in the steam chamber, so any droplets of water that might enter the steam chamber evaporate there anyway.

The housing is preferably formed at least in part by a portion of the bordering wall of the inlet line which is shaped in the direction of the interior of the inlet line. Thus the steam chamber is surrounded by the inlet line for at least a portion of its outside circumference and accordingly is heated by the steam flowing in the inlet line. This yields a very good and accurate means of coordinating the temperature of the incoming steam with the temperature of the steam chamber so that condensation of the water cannot occur due to sudden changes in temperature.

It is also preferable for the nozzles to be arranged in a diffusor plate which seals the steam chamber toward the outside. Such a diffusor plate can easily be manufactured with the required precision. This design has the advantage that it is easy to manufacture, especially in conjunction with the steam chamber bordered by the inlet line.

The diffusor plate is preferably connected to the bordering wall of the inlet line in such a way that it can conduct heat. Thus the diffusor plate is also heated by the inlet line or more precisely by the steam flowing in the inlet line. The droplets of water which nevertheless strike the diffusor plate are then evaporated very rapidly. The result achieved in this way is that the steam chamber is heated by the inlet line on all sides or at least on all four sides. This makes it possible to establish a relatively uniform temperature distribution in the interior of the steam chamber.

The diffusor plate and/or the baffle plate is preferably made of a material that has approximately the same thermal expansion coefficient but a much better thermal conductivity with respect to the material of the bordering wall of the inlet line. The thermal conductivity may be higher by a factor of 10 or more than the thermal conductivity of the material of the bordering wall of the inlet line. This design has the advantage that the connections between the diffusor plate or the baffle plate and the bordering wall of the inlet line can be kept small due to the problem of thermal stress on the one hand while on the other hand the high thermal conductivity assures that the diffusor plate or baffle plate is always kept at a relatively high temperature, especially more than 100° C., which is practically the same as the temperature of the steam flowing in the inlet line. First, the diffusor plate radiates heat outward but secondly, however, heat is also supplied to it from the inlet line. The better the thermal conductivity of the diffusor plate, the more rapidly can the radiant heat be resupplied, so there is little or no drop in temperature of the diffusor plate. Due to the fact that the steam is decompressed in the steam chamber located downstream from the valve, the diffusor plate and the baffle plate may actually be hotter than the steam in the steam chamber.

It is preferable here for the diffusor plate and/or the baffle plate to be made of copper while the bordering wall of the inlet line will usually be made of stainless steel. Copper and stainless steel have essentially the same thermal expansion coefficient which is calculated as a linear expansion coefficient $\alpha$. On the other hand, copper has a thermal conductivity $\lambda$ which is 10 to 37 times greater than that of stainless steel such as chromium nickel steel or chromium steel with 5% Cr. With this combination of materials, it is thus possible to assure an adequate mechanical stability while also achieving the desired temperature distribution.

The housing of the steam chamber may also be provided with heating channels that are connected to the interior of the inlet line and through which steam can flow. Due to this design, additional heating channels are necessary but a very controlled heating of certain parts of the steam chamber can be achieved.

Preferably the nozzles are formed by boreholes which are arranged essentially in two rows that are offset with respect to each other in such a way that one borehole of one row is located upstream or downstream from an interspace between the boreholes in another row in the direction of travel of the web of material to be treated with moisture. Therefore, the boreholes can be arranged close together, as seen in the direction of travel of the web of material, without any negative effects on the mechanical strength as a result of this close arrangement.

In an alternative design, the nozzles may be designed as slotted nozzles. This also assures a uniform steam treatment over the entire width of the web of material.

The nozzles are preferably arranged in zones, so the nozzles of one zone can be supplied from one steam chamber which is separate from and is controlled separately from the steam chambers belonging with the other zones. Thus one must merely control the steam pressure or the amount of steam in the individual steam chambers, which is preferably accomplished through the valve assigned to the steam chamber in order to vary the amount of steam applied from one nozzle zone. The possibility of adjusting the amount of steam applied by zones permits regulation or control of the smoothness or gloss in the transverse direction of the web of material.

It is preferable here for the nozzle arrangements in neighboring zones to be arranged so they overlap. For structural reasons, the nozzles of each zone usually cannot be arranged directly at the edge, so with a simple arrangement of zones side by side, this would result in gaps between individual zones that would be noticeable due to striations in the gloss or smoothness. However, this negative effect can now be avoided due to the fact that individual nozzle arrangements are now aligned so that they overlap.

The overlapping effect can be achieved in an especially simple manner due to the fact that the rows form an acute angle with respect to the direction of the longitudinal axis of the inlet line. Thus the individual nozzle arrangements are not offset completely toward the front or toward the rear in the direction of travel. They do not stand at a right angle with respect to the direction of travel of the web of material but instead they form an acute angle so that very uniform moistening of the web of material is achieved. This moistening takes place essentially at the same distance from the roller gap, based on the width of the web of material.

Preferably this angle is adjustable. This makes it possible to vary the width of the overlap between neighboring zones and adjust it to a desired value.

Preferably the nozzles have a diameter smaller than their length. This makes it possible to produce a flow of steam from the nozzles at a relatively high velocity and also with a defined direction. Consequently, the layer of air adhering to the web of material can be broken up to an even better extent and the web of material can be moistened accordingly.

This problem is solved in a process of the type defined initially by the fact that a constant steam pressure is adjusted for all zones together on at least one side of a web of material and if there is a difference between the setpoint and the actual value in the machine direction, the degree of opening of the valves in all zones is changed by the same amount, in which case the valves are designed as analog and linearly controllable valves, especially linear valves.

The steam pressure is adjusted as a function of the material to be processed as well as other machine parameters. It can be left practically unchanged once it has been adjusted. The steam pressure is set in such a way that a satisfactory result is normally achieved with a moderate opening of the valves. Only when there are deviations in the gloss or smoothness in the machine direction are all the valves opened or closed uniformly, in which case this permits a very simple means of control due to the linearity in the valve response. Due to this linear correlation, it is not necessary to perform any complicated calculations with regard to the degree of opening prevailing before the actuation of the valve in controlling the valves. Instead, in reducing or increasing the control signal for the individual valves, it can be assumed that the amount of steam dispensed is also increased or reduced accordingly, i.e., proportionally. The linear valve response is achieved in an especially simple manner by using linear valves, i.e., analog valves whose flow rate is directly proportional to the control signal. Such valves are also referred to as proportional valves. The linear valve function can also be achieved by connecting a conversion unit upstream to take into account the valve characteristic, i.e., the dependence of the flow rate on the degree of opening. In many cases, this relationship obeys a natural logarithm law. Due to the linear valve characteristic, individual parameters such as the gloss and/or smoothness values in the machine direction or in the transverse direction of the machine can be separated from each other relatively well because the steam flow rates that correlate with the individual parameters are superimposed linearly. This also makes it easier to take into account the dependence prevailing in other zones.

When there is a deviation between the setpoint and the actual value in the transverse direction of the machine, the valves of the individual zones are preferably adjusted independently of each other and as a function of only the difference prevailing in their individual zones. This also permits a means of regulating or controlling the gloss or smoothness in the transverse direction of the machine, i.e., across the direction of travel of the web of material. Here again a linear characteristic of the valves is advantageous if, for example, 5% more steam is needed due to a deviation and the valve is opened accordingly without having to take into account a dependence on the position assumed previously.

In an especially preferred embodiment, the amount of steam dispensed is increased or reduced according to a given function, essentially independently of the actual values determined, when accelerating or decelerating the web. When accelerating or decelerating the web—which necessarily occurs whenever rolls of webs of material are calendered, because the calender must be accelerated at the beginning of the web until reaching the full working speed and then must be decelerated again at the end—there is an increase in the gloss or smoothness values beyond the desired extent if the steam treatment remains uniform. However, it is difficult or impossible to detect this increase with the usual sensors that move across the width of the web of material. However, since this effect is known to occur, one can become independent of the values determined by the sensor in this operating state and can simply increase or decrease the amount of steam dispensed per unit of time by using a fixed function. Then naturally the present prevailing value which has been adjusted independently of the prevailing actual state can be taken as the starting point.

Preferably the given function describes a linear dependence as a function of time or the velocity of the web. The simplest design is a linear dependence on time. However this does not yield very good results because the increase in velocity of the web is strictly linear in very few cases but the control expense required is relatively low. Better results are achieved when the amount of steam is made dependent on the velocity of the web. In this case, however, it is also necessary to process a velocity signal.

It is especially preferred here for the change in the steam flow rate to be initiated as a function of a signal which initiates the change in velocity of the web. Such a signal can be obtained from the drive motors of the calender. For example, this signal may send the command to the drive motors of the calender to accelerate or decelerate the calender or the roller gap array. Since the characteristic response of the roller gap array is known—in other words, how much time will elapse after the signal before there is a change in velocity—this signal can also be used for steam control, or more precisely, for initiating the change in the amount of steam dispensed.

It is advantageous for at least a portion of the steam to be applied upstream from the first roller gap, especially from both sides of the web of material at the same time. The greatest change in the surface takes place in the first roller gap(s). The moisture applied to the web facilitates this change with regard to improved gloss and/or smoothness values, so that applying moisture upstream from the first roller gap yields better results on the whole.

It is also preferable for the steam treatment of one side of the web of material to be applied through at least two steam spray tubes. In this case, greater freedom in controlling the amount of steam applied is possible.

Thus, for example, one of the steam spray tubes may be controlled in such a way that it compensates for differences between the setpoint and the actual value in the direction of travel of the web of material in the machine, while another steam spray tube is controlled so that it compensates for differences in the transverse direction of the machine. This greatly simplifies regulation and control, especially with valves having a linear function, because the steam flow rates are superimposed linearly.

In an alternative or additional embodiment, one of the steam spray tubes can be used for a coarse adjustment of the steam flow rate and the other steam spray tube can be used for a fine adjustment of the steam flow rate. This permits a very accurate adjustment of the amount of steam dispensed in the treatment.

In another alternative, one steam spray tube can be switched on after the capacity limit of one of the other tubes has been reached. Thus, the capacity of a steam tube, in other words, the maximum amount of steam that can be dispensed or the maximum flow rate, can be kept within relatively narrow limits, which facilitates design and construction.

Finally, all the steam spray tubes can also be connected in parallel. In this case, the distribution of steam among the different processing sections is the important factor to be taken into account.

When a difference is found between the setpoint and the actual value, a quotient is first formed from the difference and the maximum value for the gloss and/or smoothness, and the steam flow rate is increased or reduced by an amount calculated by multiplying the quotient thus obtained times the maximum steam flow rate. Thus, the steam flow rate is adjusted according to the gloss and/or smoothness.

When the steam flow rate is adjusted in one zone to compensate for a difference between the setpoint and the actual value in the transverse direction of the machine, the steam flow rate in at least one other zone is preferably adjusted in the opposite direction in order to keep the total amount of steam dispensed constant. The term "steam flow rate" refers of course to the amount of steam dispensed per unit of time. As a result of this compensation effect, the gloss and/or smoothness is kept constant on the whole. Otherwise, there could be an increase or reduction in the average gloss and/or smoothness as a result of an increase or reduction in steam flow rate in one zone.

It is preferable here for the steam flow rate which is adjusted in the opposite direction to be distributed among several zones. This prevents an extreme value from being obtained. The change in flow rate distributed among several zones is thus not so noticeable.

In another preferred embodiment, a predetermined minimum steam flow rate and/or maximum steam flow rate is adjusted for all zones as a function of the material of which the web is made. These steam flow rates can be stored, for example, together with the setpoint which is given for the web of material. The minimum steam flow rate shortens the startup time and thus minimizes the amount of material wasted. The amount of steam is adjusted to the proximity range of the value which assures the desired gloss and/or smoothness. By limiting the steam flow rate to a certain maximum, the material is protected. Especially when working with coated paper, an excessive steam flow rate can have a negative effect on the coating.

An embodiment whereby the difference between the amount of steam dispensed in neighboring zones is limited to a predetermined maximum is especially advantageous. First, this reduces the load on the rolls in the roller gap arrangement. Secondly, this prevents striations in the gloss and/or smoothness. The web of material thus has a more uniform appearance.

BRIEF DESCRIPTION OF THE DRAWINGS

This invention will be described in greater detail below on the basis of the figures which show the following.

DESCRIPTION OF THE PREFERRED EMBODIMENTS

Figure 1:
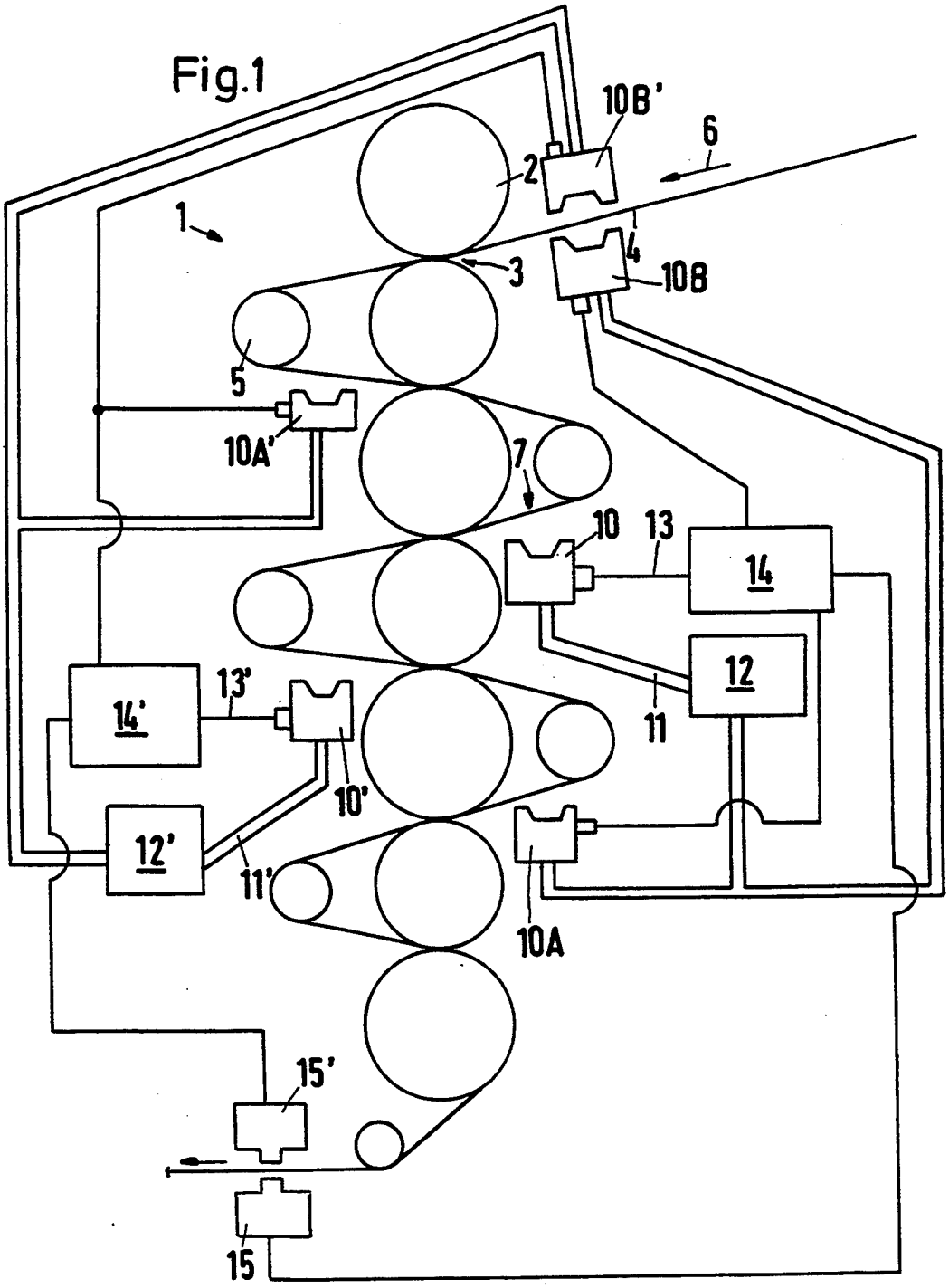
FIG. 1 shows a calender with steam tubes.

A calender 1 has several working rolls 2 between which roller gaps 3 are formed. A web of material 4 such as a web of paper passes through roller gap 3 and then is guided over deflector rolls 5. Therefore, an essentially linear section 7 of web 4 of material is formed between a deflector roller 5 and a roller gap 3 downstream from it in the direction 6 of travel of the web and a steam spray tube 10 is arranged on the underneath side of the web 4. Another steam spray tube 10' is provided for another side of the web of material. The two steam spray tubes 10, 10' may be of the same design.

Steam spray tube 10 is connected to a steam source 12 by way of a steam transport line 11. Furthermore, steam spray tube 10 is connected to a control unit 14 by way of a signal line 13. Control unit 14 is in turn connected to measurement device 15 which determines the gloss or smoothness of the surface of web 4 of material downstream from the last roller of calender 1 and relays this information back to the control unit 14. Control unit 14 then compares the actual value for the gloss or smoothness of the web 4 of material thus determined with a given setpoint and adjusts the amount of steam dispensed through steam spray tube 10 as a function of the difference between the setpoint and the actual value.

The same parts with key numbers in the figures also have the same key numbers with a prime (') for the other side of the web of material, where steam sources 12, 12' and control units 14, 14' can also be provided together for both steam spray tubes 10, 10'.

In addition, other steam spray tubes 10A, 10A' and 10B, 10B' may also be provided. The steam spray tubes whose numbers have a prime are used for the top side of the web of material 4, while the other numbers are for the underneath side of the web of material. All the steam spray tubes 10, 10A, 10B and 10', 10A' and 10B' can be supplied by the same control units 14, 14' and the same steam sources 12, 12'.

It should be noted in particular that the steam spray tubes 10B, 10B' are arranged opposite each other so that steam spray tube 10B' is arranged "overhead." This can be achieved only when, as shown in the present embodiments of the steam spray tubes, conveyance of water droplets onto the web of material 4 can be reliably prevented.

Treating the web of material 4 with moisture upstream from the first roller gap 3 of calender 1 has the effect that the required shaping work in the surface of web of material 4 is accomplished in the first roller gap 3 with the support of the moisture which may optionally plasticize the surface or the entire web of material to a certain extent.

Due to the fact that the steam treatment is divided among several steam spray tubes 10, 10A, 10B and 10', 10A', 10B', different control methods can now be implemented. As an example it should be pointed out that one of the steam spray tubes for the steam and/or smoothness treatment is responsible for the machine direction, i.e., the direction of travel 6 of the web of material, while another steam spray tube is responsible for the transverse direction of the machine. In another embodiment, a steam spray tube can be responsible for the coarse setting and another steam spray tube can be responsible for the fine setting of the gloss and/or smoothness values. Finally, a steam spray tube may be turned on when another steam tube has reached its capacity limit. However, all the steam spray tubes may also be controlled in parallel.

Figures 2, 3:
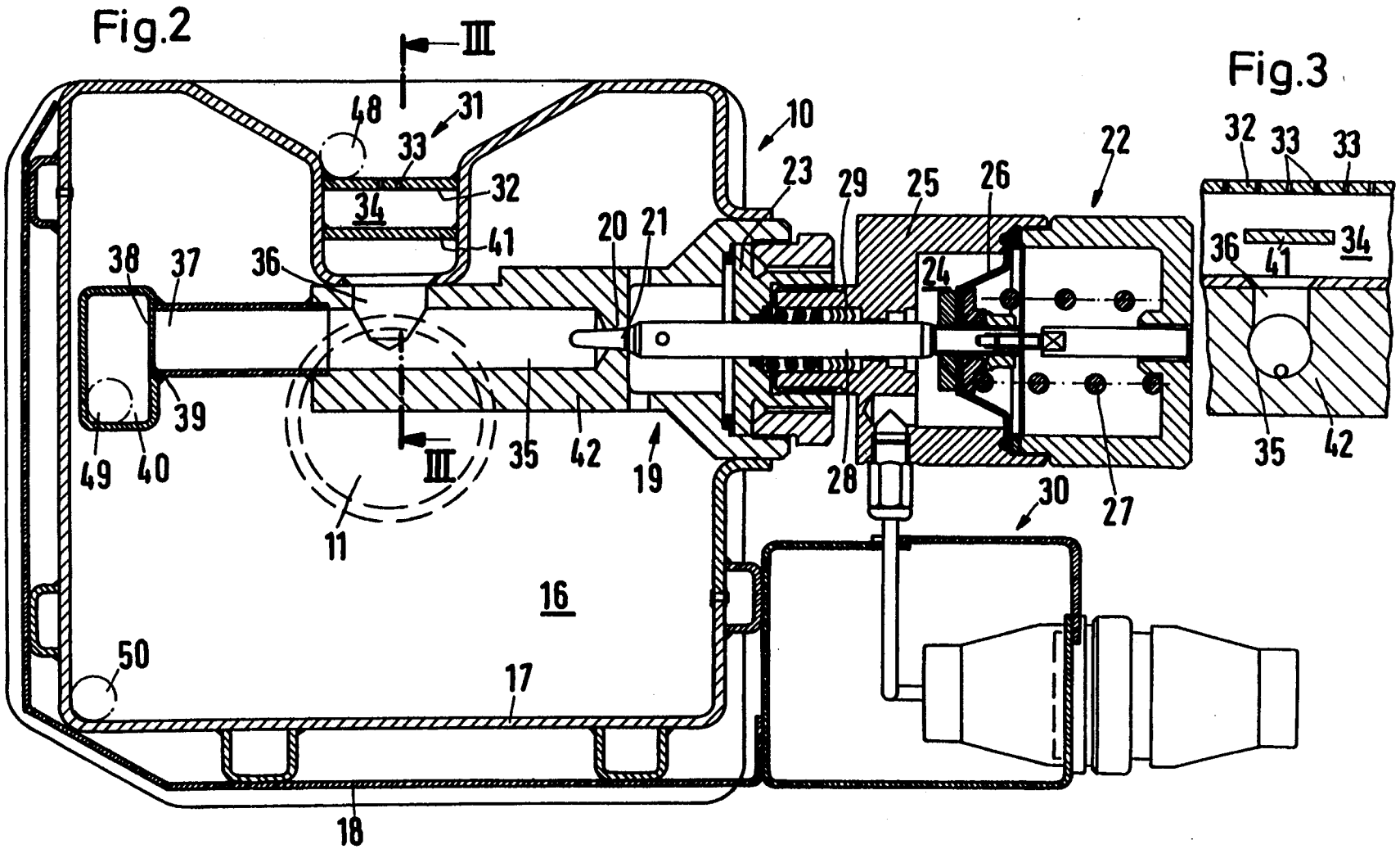
FIG. 2 shows a first embodiment of the steam tube.
FIG. 3 shows a section III—III according to Figure

FIG. 2 shows the details of the design of a first embodiment of such a steam spray tube 10 whereby the steam transport line 11 opens into an inlet line 16. Inlet line 16 is provided in a housing 17 which is surrounded at least in part by a thermal shield 18.

In the interior of housing 17, there is a valve 19 or more precisely a valve seat 20 and closing piece 21. Valve 19 has a drive part 22 located outside of housing 17. The drive part is connected to housing 17 with thermal insulation 23 inbetween, for example, in the form of a disk of plastic that has little or no thermal conductivity, so there is little or no transfer of heat from housing 17 to drive part 22.

Valve 19 is pneumatically operated. Therefore, it has a pressure chamber 24 which is surrounded by the drive housing 25 and a membrane 26. The membrane is under load from a spring 27 on the side facing away from pressure chamber 24. The closing piece 21 is connected by drive rod 28 which is guided in drive housing 25 with the help of gaskets 29 which seal it (is connected to membrane 26) so the closing piece 21 also moves with a movement of membrane 26. The pressure in pressure chamber 24 is adjusted with the help of a pneumatic valve arrangement 30 which is shown only schematically.

Valve 19 is designed as a so-called linear valve, which means that the amount of steam allowed to pass through valve 19 is a linear function of a signal supplied to drive part 22, for example, the air pressure supplied to drive part 22. If the signal responsible for actuation of the valve is increased by 10%, valve 19 will also allow 10% more steam to pass through, regardless of which position valve 19 previously occupied. Of course, limiting situations in which valve 19 cannot open or close further are excluded from this.

Housing 17 is curved inward on the side facing web of material 4 and it has a U-shaped recess 31 whose open end faces the web of material and is sealed by a diffusor plate 32. Nozzles 33 which are arranged in two rows are provided in the diffusor plate in which case the two rows of nozzles are offset relative to each other in the transverse direction of the web of material in such a way that the nozzles 33 of one row are in front of or behind a gap between nozzles 33 in the other row in the direction of travel 6 of the web of material 4. Housing 17 and a diffusor plate 32 together enclose a steam chamber 34. The nozzles 33 and steam chamber 34 together form a nozzle array. The steam chamber 34 is supplied with steam from the inlet line 16 through valve 19. An essentially linear acceleration channel in which a nozzle channel 36 branches off at a predetermined distance from its end 37 is provided downstream from valve 19 and upstream from steam chamber 34 in the direction of flow of the steam. The end 37 of the acceleration channel 35 is sealed off by a baffle plate 38 at whose lowest point in the direction of gravitational pull there is an opening 39 which is designed in the form of a throttle and through which the acceleration channel 35 is connected to a discharge channel 40.

Furthermore, a baffle plate 41 is arranged in the steam chamber 34, namely in the extension of the nozzle channel 36 in such a way that the direct path from the nozzle channel 36 to nozzles 33 is blocked. Thus the steam coming from nozzle channel 36 must undergo a change in direction at least once before reaching nozzles 33.

The length of nozzles 33 is greater than their diameter. This makes it possible to produce a directed steam jet.

The diffusor plate 32 and baffle plate 41 are welded to housing 17 or are connected in some other way that permits conduction of heat. Especially diffusor plate 33 but also baffle plate 41 have the same linear thermal coefficient of expansion as housing 17. For the diffusor plate 32 and baffle plate 41, for example, the thermal expansion coefficient may be $17\times10^{-6}$ m/(mK) and for housing 17 it may be $16\times10^{-6}$ m/(mK). However the thermal conductivity of diffusor plate 32 is much greater than that of housing 17. For example, with diffusor plate 32 and baffle plate 41, the thermal conductivity may be about 380 W/(mK), whereas for the housing it is about 10–15 W/(mK). Such a combination of materials can be achieved, for example, by using copper for diffusor plate 32 and baffle plate 41 and using chromium nickel steel or some other stainless steel for housing 17.

Steam spray tube 10 operates as follows. The inlet line 16 always has steam flowing through it at a predetermined pressure. An attempt is made to keep this steam as dry as possible. However, in practice it is hardly possible to prevent small water droplets from forming occasionally and then being entrained with the steam. Valve 19 is opened to a value that is predetermined by control unit 14. Then the steam can flow from inlet line 16 into acceleration channel 35. Any droplets of water that might be present in the steam will of course also flow through valve 19. The water droplets which have been reduced to a relatively slow speed (based on the direction of movement of the steam) as a result of the change in direction in passing through the valve are then accelerated in acceleration channel 35. Then the steam is directed or deflected at right angles into nozzle channel 36 which is located a considerable distance (in the present case, half of the length of the acceleration channel) upstream from the end 37 of acceleration channel 35. The water droplets which now have a considerable velocity cannot undergo such a rapid change in direction. They continue straight ahead and either strike baffle plate 38 or are precipitated at the lowest point in the direction of gravitational pull at the end 37 of the acceleration channel 35. The resulting accumulation of water can then flow through opening 39 into discharge channel 40. In this case the water flowing out of opening 39 seals it off so there cannot be any mentionable losses of steam here. Although opening 39 does not serve directly to remove water into discharge channel 40, it is designed as a throttle. In other words, it presents a certain flow resistance to the steam, so that most of the steam flowing through valve 19 except for a negligible residue can also leave through nozzles 33.

Acceleration channel 35 is arranged in a housing 42 that is located completely in the interior of housing 17, in other words, inside of inlet line 16. Housing 42 thus is at the same temperature as the steam flowing in inlet line 16. Therefore, it is hot enough to be able to evaporate any water droplets that strike it.

If the steam flowing through nozzle channel 36 is still loaded with water droplets, they will also strike baffle plate 41 because they cannot also change directions with the steam as is necessary for flowing around baffle plate 41. Thus the steam which should finally be discharged through nozzles 33 is practically free of water. If, contrary to expectations, individual droplets of water are still present, there is a relatively high probability that they will not reach nozzles 33 but instead will strike the heated walls of steam chamber 34 where they will evaporate. The walls of steam chamber 34 including diffusor plate 32 are at the same temperature as the steam flowing in inlet line 16 whereas the steam in steam chamber 34 is at a somewhat lower temperature due to the pressure drop caused by valve 19.

Due to the acceleration channel, optionally supported by baffle plate 41 and heated steam chamber 34, the steam can be fed at a relatively high pressure into steam chamber 34 where it is distributed uniformly and can be dispensed at a uniform pressure through all nozzles 33 of a nozzle array provided for this steam chamber 34. Due to the relatively high pressure in steam chamber 34, the steam can develop a relatively high velocity in escaping through nozzles 33 so it or the mist evolved from it in the ambient air will also strike the web of material 4 at a high velocity or a high pressure. This causes the steam to pass through the layer of air adhering to the web of material so the water in the steam can be precipitated on the web of material 4 so adequate moisture is imparted to the web of material 4 in order to achieve the desired gloss or smoothness in the downstream roller gap 3. The danger that water droplets will escape through nozzles 33 and result in damage to web of material 4 is extremely low so it is practically negligible. Therefore, the steam velocity can be increased considerably in comparison with traditional tubes and therefore higher velocities for the web of material can also be allowed.

Figure 5:
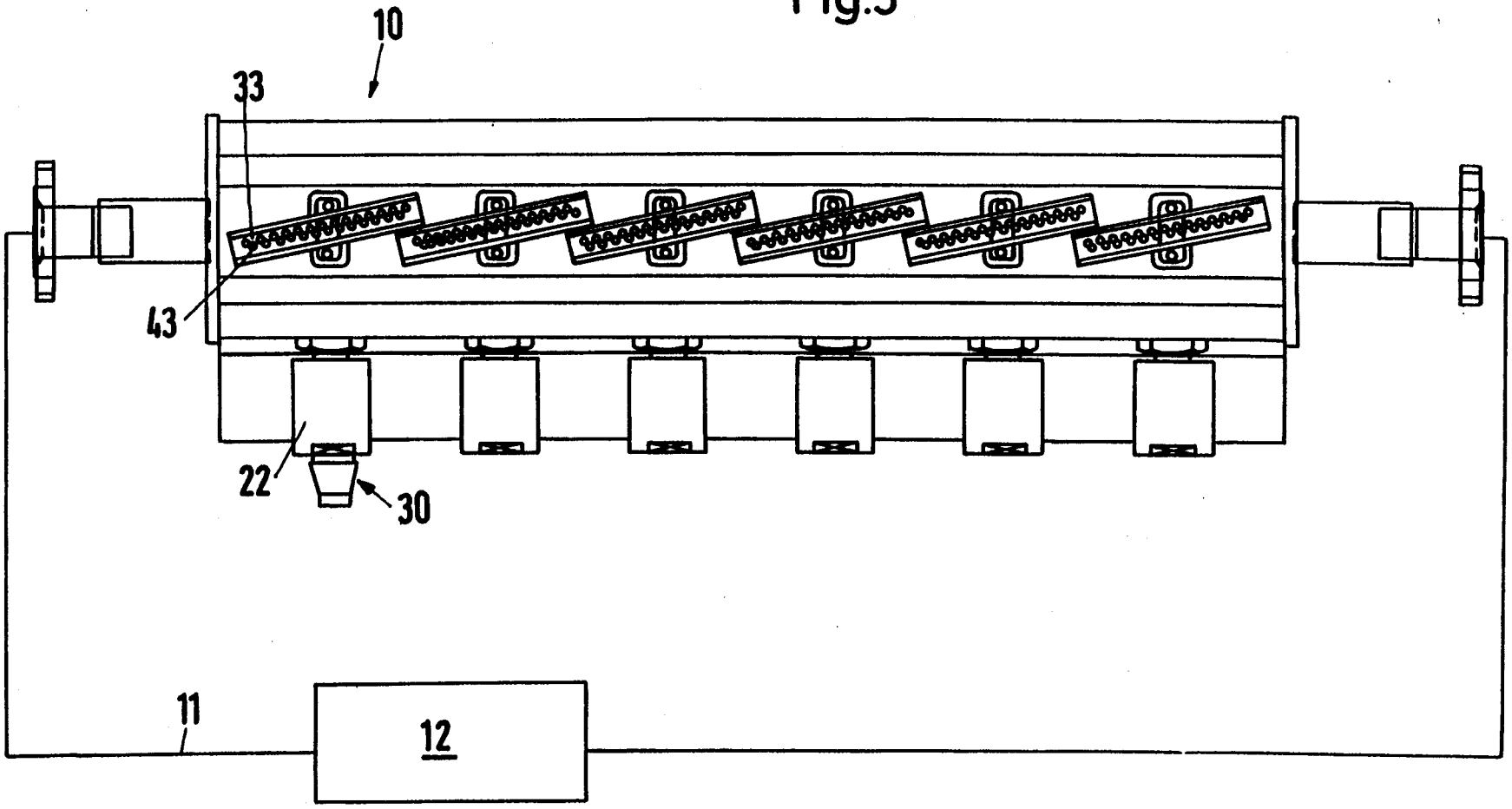
FIG. 5 shows a top view of the steam tube.

FIG. 5 shows a top view of a steam spray tube 10 from which it can be seen that each steam spray tube 10 has several nozzle arrays 33 arranged in zones. This makes it possible to treat the width of the web of material 4 with different amounts of steam. Nozzles 3 are arranged in rows which form an acute angle with the transverse direction of the machine, i.e., a direction across the direction of travel of the web of material. This makes it possible for nozzle arrays 33 of adjacent zones to overlap. This also assures that the web of material passing through the systems will be treated with a sufficient amount of steam even at the border between two zones.

As FIG. 5 also shows, the transport line 11 for steam may be designed in the form of a ring so the steam flowing through steam spray tube 10 without being used or condensed water is returned to steam source 12. This assures that the steam will always have the required temperature. Even before the actual start of operation, the steam spray tube including all the parts contained in it and the parts around which steam flows can be heated before actually starting operation. So that even at the start of operation, there is no problem with water droplets that have condensed on cooled parts of the steam spray tube 10.

As FIG. 5 also shows, each zone also has its own valve, of which only the drive parts 22 and valve arrangements 30 can be seen.

For operation, a steam pressure is established and will then prevail in inlet line 6. This steam pressure does not usually change during operation. It depends on calender 1 and the web of material 4 to be treated. The gloss or smoothness values are determined by measurement devices 15 and 15' and this information is then sent to control units 14, 14' which then adjusts the degree of opening of valves 19 in such a way as to yield a desired gloss and smoothness of the web of material. If the resulting values differ from the set values, valves 19 are adjusted accordingly, and this adjustment can be made by zones if there is a deviation across the direction of travel of the web of material or the adjustment may be made for all valves 19 together if there is a deviation in the direction of travel of the machine. For example, in the latter case, all the valves may be opened uniformly by 10% in order to dispense a 10% larger amount of steam. This is especially simple to control due to the use of linear analog valves.

Figure 4:
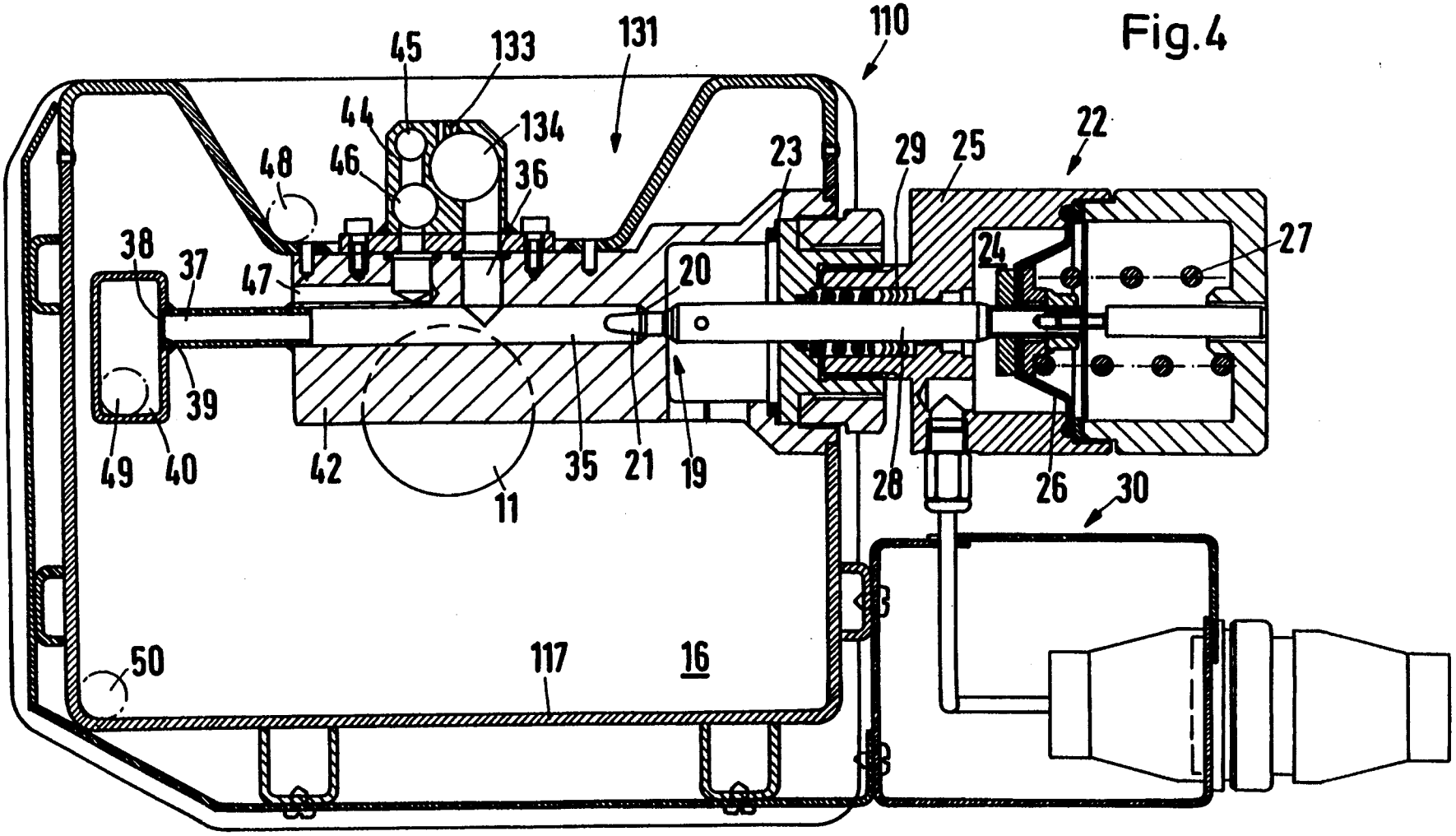
FIG. 4 shows a second embodiment of the steam tube.

FIG. 4 shows a second embodiment of a steam spray tube where the same parts are provided with the same reference numbers and corresponding parts have reference numbers that are higher by 100.

The U-shaped recess 131 in housing 117 is broader in this embodiment so it no longer directly encloses steam chamber 134. Instead, steam chamber 134 here is arranged in a separate block 44 that is bolted onto housing 117 or a part that is permanently connected to it such as housing 42 of acceleration channel 35.

Block 44 contains steam channels 45, 46 that are connected to inlet line 16 by way of an auxiliary channel 47 and can be supplied with hot steam through this line. With the help of steam channels 45 and 46, block 44 is heated to the extent that steam chamber 134 is surrounded by heated walls on all sides. Steam channels 45 and 46 always have steam flowing through them. In other words, they have steam outlets (not shown) at the end from which steam can be supplied back to steam source 12 if necessary.

Nozzle channel 36 opens tangentially into steam chamber 134. Nozzles 133 are offset at the side in such a way that they are outside the projection of the mouth of nozzle channel 36 onto the wall of steam chamber 134. Again in this case no steam can reach nozzles 133 from nozzle channel 36. Instead, the steam must first be distributed in steam chamber 134 before it can reach nozzles 133.

In both embodiments, siphons 48, 49 and 50 with the help of which water that collects can be disposed of in a known way are provided at the lowest points in the direction of gravity.

Figure 6:
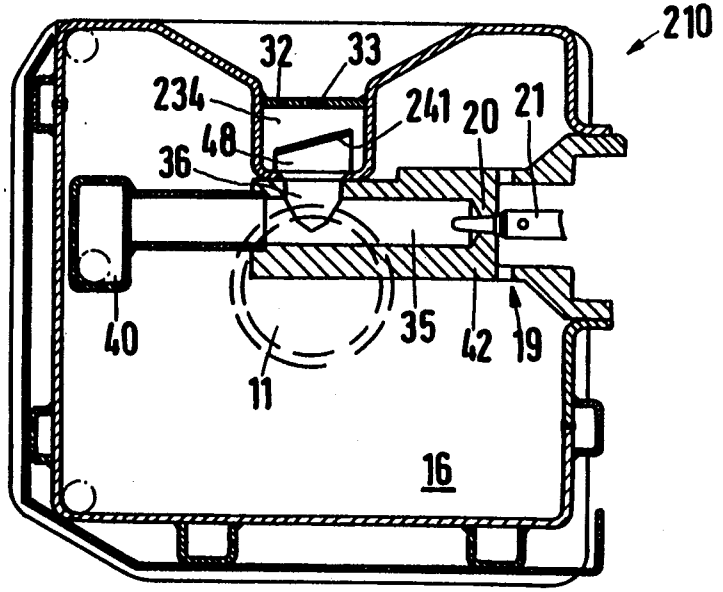
FIG. 6 shows a third embodiment of the steam tube.

FIG. 6 shows a cross section through another steam spray tube 210 whereby parts that correspond to the parts in FIG. 2 are provided with the same reference numbers and corresponding parts are provided with reference numbers plus 200.

Only baffle plate 241 is different. In this case it is no longer arranged at right angles to the direction of the intermediate channel 36 but instead is inclined relative to it. Baffle plate 241 thus forms an inclined plane with respect to the incoming steam from nozzle channel 36, so the steam is almost necessarily directed at the right wall of steam chamber 234 as shown in FIG. 6. This is the wall facing valve 19, so this assures that there will always be a certain steam flow through incoming line 16 here. This wall will thus always be hot. Only a negligible portion of the steam will reach the opposite wall.

Figure 7:
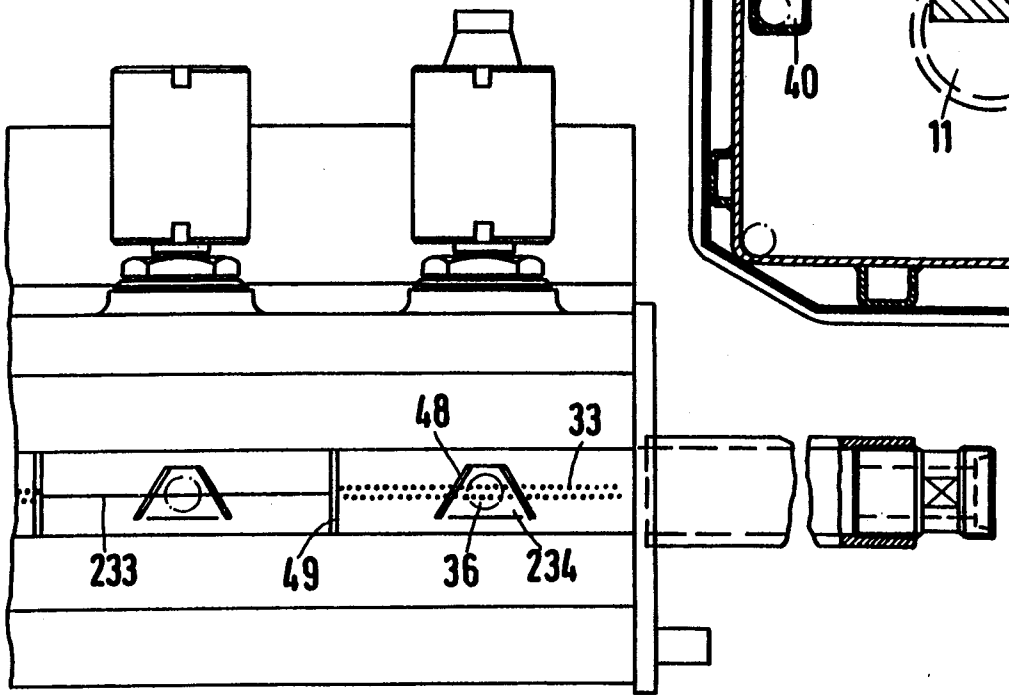
FIG. 7 shows a top view of the steam tube according to FIG. 6.

Baffle plate 241 is not connected to the side walls of steam chamber 234 as in FIG. 20 but instead is connected by its own side walls 48 to the bottom of steam chamber 234, in other words, to the walls around the mouth of nozzle channel 36. FIG. 7 also shows that the side walls 48 open toward said steam chamber wall, so there is further alignment of the steam toward the side wall here.

If the steam spray tube 210 shown in FIG. 6 is used "overhead" so the nozzles 33 point downward, the slope of the baffle plate assures that water which might still be precipitated will drip onto an area of diffusor plate 32 that is outside of nozzles 33. Since the copper diffusor plate is always at the temperature of the steam flowing in inlet line 16, in other words, it is hotter than 100° C., the water dripping onto diffusor plate 32 will evaporate immediately and therefore can no longer escape through nozzles 33.

FIG. 7 also shows that individual zones are separated from each other by partitions 49. The right zone of the two zones shown in this figure has nozzles 33 in two rows. The left zone of the two zones shown here has a slotted nozzle 233 from which the steam can also escape relatively uniformly. The width of the slot is smaller than the thickness of diffusor plate 32.

Figure 8:
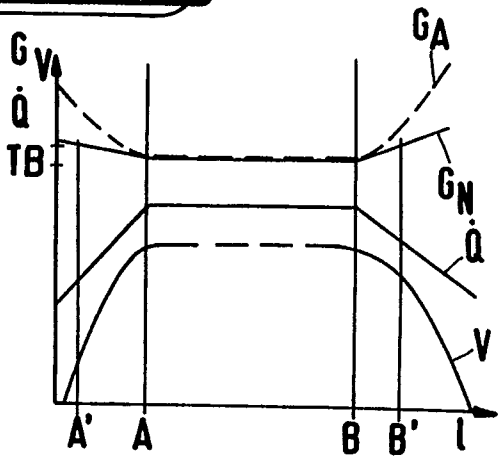
FIG. 8 shows a schematic diagram of the amount of steam dispensed.

With reference to FIG. 8, the method of controlling the steam flow rate Q° will now be explained. In FIG. 8, the length of the web of material to be treated is plotted at the right and the gloss or smoothness G, the velocity V and the steam flow rate dispensed Q° are plotted at the top. The beginning of the web of material is first threaded through a calender. Then the calender is accelerated so the speed of the web of material increases according to the curve V. After a certain period of time which is characterized by point A in FIG. 8, the web of material reaches its working speed which is then kept as constant as possible. Just before the end of the web, namely at point B, the velocity must be reduced again so the treatment can be concluded properly and there will not be any hazardous situation.

If the process were operated with an essentially constant steam flow rate, then an unacceptably high gloss or smoothness value would be obtained at the beginning and at the end of the web, as represented by the dotted line $G_A$. Then waste would be produced between the start of the web and point A and between point B and the end of the web because the gloss and/or smoothness would be outside the range of tolerance TB.

However, if the amount of steam dispensed Q° is varied as a function of this effect in accordance with the curve Q° shown here which has sections with a linear positive or negative slope at the beginning and end, then the gloss or smoothness would change only in accordance with the curve $G_N$ so that much larger portions of the web would still be within the tolerance range TB with regard to the gloss or smoothness. The points before or after which the material produced would have to be rejected are then shifted to A′ and B′.

The influence on the steam flow rate Q° is achieved here regardless of the signals of sensors 15 and 15′ because as a rule these sensors traverse the width of the web of material and thus are too slow to be able to detect the changes in gloss and/or smoothness that occur as a result of a change in the velocity of the web of material. The steam flow rate can also be adjusted as a function of time or the velocity of the web.

While the particular steam spray tube and metod for adjusting the gloss and/or smoothness of a web of material as herein shown and disclosed in detail is fully capable of obtaining the objects and providing the advantages herein before stated, it is to be understood that it is are merely illustrative of the presently preferred embodiments of the invention and that no limitations are intended to the details of construction or design herein shown other than as described in the appended claims.

What is claimed is:

1. A steam spray tube comprising:

an inlet line for steam;

a nozzle array;

a valve having a valve seat and being arranged between the inlet line and the nozzle array;

an essentially linear acceleration channel having an end, said linear acceleration channel being arranged downstream from the valve in the direction of flow of the steam, with said linear acceleration channel extending from said valve seat to said end, such that water droplets in steam contained within said channel are accelerated from said valve seat towards said end; and a nozzle channel which branches off to the nozzle array from the acceleration channel at a predetermined distance upstream from the end of the acceleration channel.

2. The steam spray tube as recited in claim 1 wherein the acceleration channel is arranged in a channel housing located completely inside the inlet line.

3. The steam spray tube as recited in claim 2 wherein the acceleration channel is sealed at the end by a baffle plate having an opening in the area of its lowest point as seen in the direction of gravity.

4. The steam spray tube as recited in claim 3 wherein the acceleration channel is connected by an opening to a discharge channel.

5. The steam spray tube as recited in claim 3 wherein the opening is designed as a throttle.

6. The steam spray tube as recited in claim 1 wherein the valve includes a closing piece and a drive part, said valve being arranged such that said valve seat and said closing piece are located inside said inlet line and said drive part is outside said inlet line.

7. The steam spray tube as recited in claim 6 wherein said drive part is thermally separated from said inlet line by a housing.

8. The steam spray tube as recited in claim 1 wherein said valve is a pneumatically operated analog valve.

9. The steam spray tube as recited in claim 1 wherein the nozzle array is positioned such that steam exits the nozzle array in the direction of gravity.

10. The steam spray tube as recited in claim 1 further comprising an opposing nozzle array of a second steam spray tube wherein the nozzle array is arranged opposite said opposing nozzle array such that the direction of the steam leaving the nozzle array is essentially opposite the direction of the steam leaving the opposing nozzle array.

11. The steam spray tube as recited in claim 1 wherein the steam spray tube is connected to a roller gap array and wherein the steam spray tube is arranged upstream from a first roller gap of the roller gap array, the roller gap array having several roller gaps.

12. The steam spray tube as recited in claim 1 wherein the nozzle array has a steam chamber in fluid communication with said nozzle channel and said nozzle array, said nozzle channel allowing steam to enter said steam chamber and said nozzle array allowing steam to exit said steam chamber.

13. The steam spray tube as recited in claim 12 wherein the steam leaving the nozzle channel changes its direction at least once inside of said steam chamber.

14. The steam spray tube as recited in claim 12 wherein a secondary baffle plate is arranged in an extension of the nozzle channel in said steam chamber.

15. The steam spray tube as recited in claim 14 wherein a normal axis of said Secondary baffle plate is inclined with respect to a longitudinal axis of the nozzle channel.

16. The steam spray tube as recited in claim 14 wherein said nozzle channel has a pair of side walls, a mouth, and a wall surrounding the mouth and wherein the secondary baffle plate is connected by said side walls to said wall surrounding the mouth of the nozzle channel, said side walls defining an opening in the direction of one wall of the steam chamber.

17. The steam spray tube as recited in claim 12 wherein the nozzle array includes nozzles and the nozzle channel opens eccentrically into said steam chamber and wherein the nozzle channel has a mouth and the nozzles are arranged outside a projection of the mouth of the nozzle channel onto an outside wall of the steam chamber (134).

18. The steam spray tube as recited in claim 17 wherein the steam chamber has an essentially circular cross section and the nozzle channel opens essentially tangentially into it.

19. The steam spray tube as recited in claim 12 wherein the steam chamber is arranged in a heated housing.

20. The steam spray tube as recited in claim 19 wherein the housing is formed at least in part by a portion of a bordering wall of the inlet line, said inlet line having an interior and said portion of said bordering wall being formed to extend into the interior of the inlet line.

21. The steam spray tube as recited in claim 19 wherein the inlet line has an interior and the housing of the steam chamber is provided with a pair of heating channels that are connected to the interior of the inlet line and through which steam can flow.

22. The steam spray tube as recited in claim 12 wherein the nozzle array includes nozzles and the nozzles are arranged in a diffusor plate which seals off the steam chamber from an outside environment and wherein said nozzles provide fluid passageways through said diffusor plate.

23. The steam spray tube as recited in claim 22 wherein the diffusor plate is connected with a bordering wall of the inlet line such that there is heat conduction between the diffusor plate and the bordering wall.

24. The steam spray tube as recited in claim 23 wherein the diffusor plate and the baffle plate are made of a material that has approximately the same thermal expansion coefficient but a much better thermal conductivity than the bordering wall of the inlet line.

25. The steam spray tube as recited in claim 24 wherein the diffusor plate and baffle plate are made of copper while the bordering wall of the inlet line is made essentially of stainless steel.

26. The steam spray tube as recited in claim 12 wherein the nozzle array includes nozzles and the nozzles are formed by boreholes arranged in at least two rows which are offset with respect to each other.

27. The steam spray tube as recited in claim 26 wherein the rows form an acute angle with respect to a longitudinal axis of the inlet line.

28. The steam spray tube as recited in claim 12, wherein the nozzle array includes a slotted nozzle.

29. The steam spray tube as recited in claim 12 wherein the nozzle array includes nozzles and the nozzles are arranged in a plurality of zones wherein nozzles of one zone are supplied by the steam chamber while the nozzles of the other zones are supplied separately by other steam chambers.

30. The steam spray tube as recited in claim 29 wherein nozzle arrays of neighboring zones are arranged so they overlap.

31. The steam spray tube as recited in claim 12 wherein the nozzles have a diameter and a length, and said diameter is smaller than said length.

32. A steam spray tube comprising:

an inlet line for steam;

a nozzle array;

a valve arranged between the inlet line and the nozzle array;

an essentially linear acceleration channel having an end, said linear acceleration channel being arranged downstream from the valve in the direction of the flow of the steam, said acceleration channel being arranged in a channel housing located completely inside the inlet line, said acceleration channel being sealed at the end by a baffle plate having an opening in the area of its lowest point as seen in the direction of gravity; and a nozzle channel which branches off to the nozzle array from the acceleration channel at a predetermined distance from the end of the acceleration channel.

33. The steam spray tube as recited in claim 32 wherein the acceleration channel is connected by an opening to a discharge channel.

34. The steam spray tube as recited in claim 33 wherein the opening is designed as a throttle.

35. A steam spray tube comprising:

an inlet line for steam;

a nozzle array;

a valve arranged between the inlet line and the nozzle array;

an essentially linear acceleration channel having an end, said linear acceleration channel being arranged downstream from the valve in the direction of the flow of steam;

a nozzle channel which branches off to the nozzle array from the acceleration channel at a predetermined distance from the end of the acceleration channel wherein the nozzle array has a steam chamber in fluid communication with said nozzle channel and said nozzle array, said nozzle channel allowing steam to enter said steam chamber and said nozzle array allowing steam to exit said steam chamber; and a secondary baffle plate arranged in an extension of the nozzle channel in said steam chamber wherein said nozzle channel has a pair of side walls, a mouth, and a wall surrounding the mouth and wherein the secondary baffle plate is connected by said side walls to said wall surrounding the mouth of the nozzle channel, said side walls defining an opening in the direction of one wall of the steam chamber.

* * * * *